US012385709B2

(12) United States Patent
Bender

(10) Patent No.: US 12,385,709 B2
(45) Date of Patent: Aug. 12, 2025

(54) TWO-STAGE TRIGGER ARRANGEMENT

(71) Applicant: In Ovation LLC, Vadnais Heights, MN (US)

(72) Inventor: Terrence Dwight Bender, Minneapolis, MN (US)

(73) Assignee: In Ovation LLC

( * ) Notice: Subject to any disclaimer, the term of this patent is extended or adjusted under 35 U.S.C. 154(b) by 0 days.

(21) Appl. No.: 17/367,345

(22) Filed: Jul. 3, 2021

(65) Prior Publication Data

US 2022/0003514 A1 Jan. 6, 2022

Related U.S. Application Data

(60) Provisional application No. 63/048,055, filed on Jul. 3, 2020.

(51) Int. Cl.
*F41A 19/45* (2006.01)

(52) U.S. Cl.
CPC ..... *F41A 19/45* (2013.01)

(58) Field of Classification Search
CPC ..... F41A 19/14; F41A 19/15; F41A 19/44; F41A 19/45
See application file for complete search history.

(56) References Cited

U.S. PATENT DOCUMENTS 4,310,981 A 1/1982 Waddell
5,463,829 A 11/1995 Sprangers
5,501,134 A * 3/1996 Milazzo ..... F41A 19/45 89/139
5,623,114 A 4/1997 Soper
5,881,485 A 3/1999 Milazzo
5,904,132 A 5/1999 Biller
6,131,324 A * 10/2000 Jewell ..... F41A 19/16 89/139
6,615,527 B1 9/2003 Martin
6,722,072 B1 4/2004 McCormick
6,772,548 B1 * 8/2004 Power ..... F41A 19/10 89/139
7,162,824 B1 1/2007 McCormick
7,188,561 B1 3/2007 Kelbly
7,293,385 B2 11/2007 McCormick
7,331,136 B2 2/2008 Geissele
7,600,338 B2 * 10/2009 Geissele ..... F41A 19/10 89/139
7,661,220 B2 2/2010 Crandall et al.
7,854,084 B1 12/2010 Rutherford
(Continued)

FOREIGN PATENT DOCUMENTS

DE 102006048436 A1 2/2008

*Primary Examiner* — Gabriel J. Klein
(74) *Attorney, Agent, or Firm* — Laabs Intellectual Property

(57) ABSTRACT

In some embodiments, a fire control mechanism comprises a trigger, a hammer and a disconnector. The trigger comprises a trigger sear and is arranged to rotate about a trigger axis. The hammer comprises a hammer sear and a secondary sear and is arranged to rotate about a hammer axis. The disconnector comprises a disconnector sear and is arranged to move with respect to the trigger. The fire control mechanism comprises an orientation wherein the trigger sear contacts the hammer sear and the secondary sear contacts the disconnector sear.

15 Claims, 8 Drawing Sheets

(56) References Cited

U.S. PATENT DOCUMENTS

| | | | | |
|---|---|---|---|---|
| 8,069,602 | B2 * | 12/2011 | Geissele | F41A 19/44 42/69.03 |
| 8,572,880 | B2 | 11/2013 | Bender | |
| 8,985,006 | B1 | 3/2015 | Christensen et al. | |
| 9,618,288 | B2 * | 4/2017 | Wilson | F41A 19/10 |
| 9,696,103 | B2 | 7/2017 | Bender | |
| 9,869,522 | B2 * | 1/2018 | Larson, Jr. | F41A 19/16 |
| 10,006,733 | B2 | 6/2018 | Bender | |
| 10,837,728 | B2 * | 11/2020 | Olson | F41A 19/44 |
| 10,948,252 | B1 | 3/2021 | Bender | |
| 2006/0086031 | A1 * | 4/2006 | Geissele | F41A 19/44 42/69.03 |
| 2007/0266845 | A1 | 11/2007 | Polston | |
| 2008/0010889 | A1 | 1/2008 | Metzger et al. | |
| 2009/0183414 | A1 | 7/2009 | Geissele | |
| 2010/0281739 | A1 | 11/2010 | Geissele | |
| 2016/0131449 | A1 * | 5/2016 | Horch | F41A 19/12 42/69.01 |
| 2018/0100712 | A1 * | 4/2018 | Tompkins | F41A 19/15 |

* cited by examiner

TWO-STAGE TRIGGER ARRANGEMENT

CROSS-REFERENCE TO RELATED APPLICATIONS

This application claims the benefit of U.S. Patent Application No. 63/048,055, filed Jul. 3, 2020, the entire content of which is hereby incorporated herein by reference.

BACKGROUND OF THE INVENTION

This invention relates generally to firearms and more specifically to trigger and fire control systems for firearms.

Fire control systems are generally used to control the release of bullets from a gun. A fire control system is limited by the specifics of the gun at issue. A gun can provide a housing cavity of predetermined size, with preset locations for a hammer, a trigger, a safety mechanism. The fire control system will typically impact a firing pin. Different guns, such as AR-style guns, AK-style guns, etc., often have fire control systems configured differently from one another. Within a single type of gun, such as an AR-style gun, there can be many different fire control designs that are each suitable to control firing but are different from one another in various ways. Various designs will have different benefits and drawbacks. For example, a very precise, light-pull trigger may be more susceptible to carbon fouling than a mil-spec trigger.

There remains a need for novel fire control arrangements that provide improvements over known designs in trigger feel, shooting experience and product longevity.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fire control mechanism comprises a trigger, a hammer and a disconnector. The trigger comprises a trigger sear and is arranged to rotate about a trigger axis. The hammer comprises a hammer sear and a secondary sear and is arranged to rotate about a hammer axis. The disconnector comprises a disconnector sear and is arranged to move with respect to the trigger. The fire control mechanism comprises an orientation wherein the trigger sear contacts the hammer sear and the secondary sear contacts the disconnector sear.

In some embodiments, the disconnector comprises a catch. In some embodiments, the catch is arranged to capture the hammer after a round is fired.

In some embodiments, the fire control mechanism comprises an orientation wherein the trigger sear contacts the hammer sear and the secondary sear does not contact the disconnector sear.

In some embodiments, a disconnector spring is compressed while the trigger sear contacts the hammer sear.

In some embodiments, a fire control mechanism comprises a trigger, a hammer and a disconnector. The trigger comprises a trigger sear and is arranged to rotate about a trigger axis. The hammer comprises a hammer sear and a secondary sear and is arranged to rotate about a hammer axis. The disconnector comprises a disconnector sear and is arranged to rotate about the trigger axis. The fire control mechanism comprises a first stage and a second stage. In the first stage, the hammer sear contacts the trigger sear. In the second stage, the hammer sear contacts the trigger sear and the secondary sear contacts the disconnector sear.

In some embodiments, disconnector comprises a catch that is oriented at an angle to the disconnector sear.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
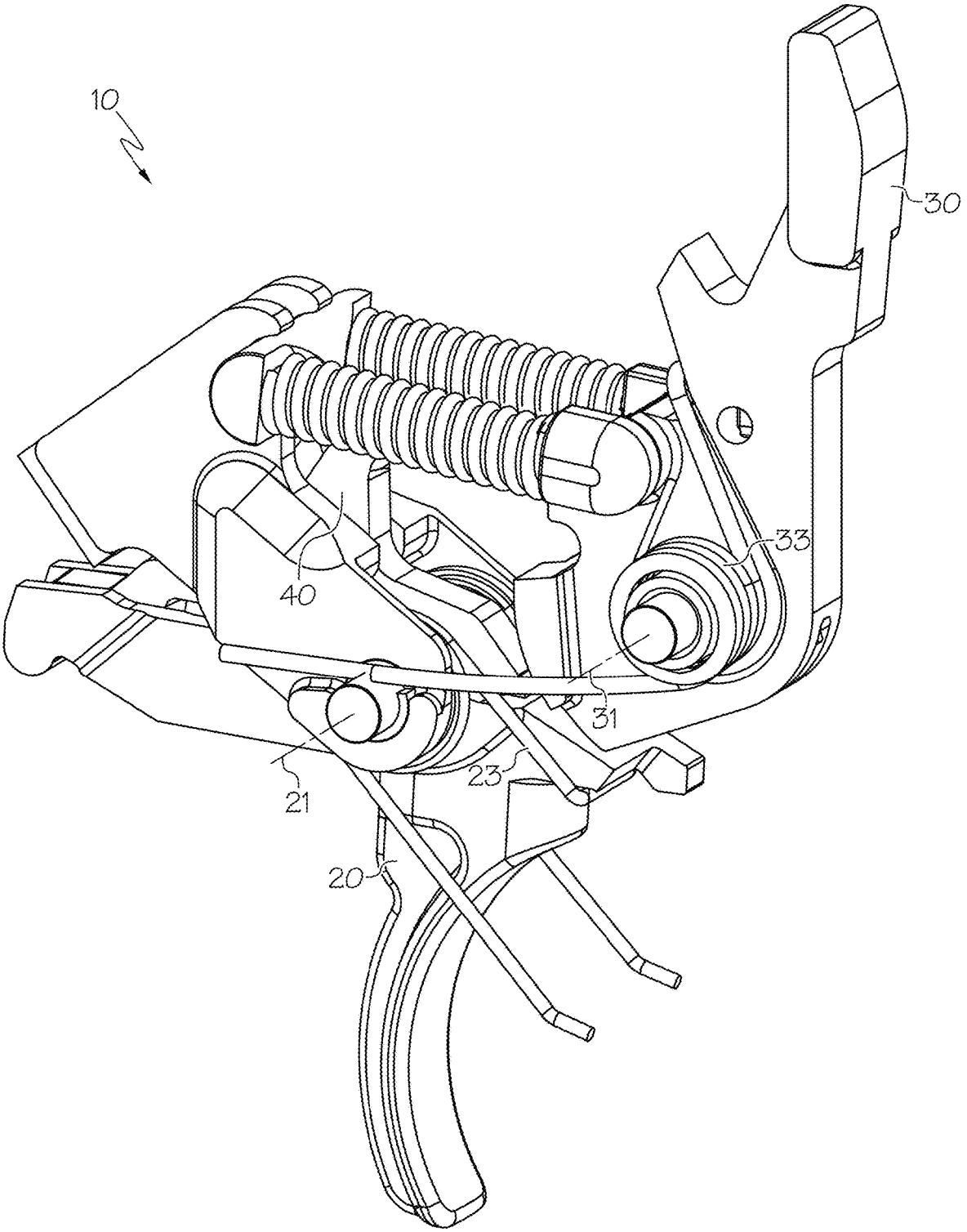
FIG. 1 shows an embodiment of a fire control mechanism.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a fire control mechanism 10. In some embodiments, a fire control mechanism 10 is configured for use in an AR-15 style firearm.

In some embodiments, a fire control mechanism 10 comprises a trigger 20 arranged to rotate about a trigger axis 21 and a hammer 30 arranged to rotate about a hammer axis 31. In some embodiments, the hammer 30 is biased in a predetermined direction (e.g. clockwise) by a hammer spring 33. In some embodiments, the trigger 20 is biased in a predetermined direction (e.g. counter-clockwise) by a trigger spring 23. In some embodiments, a fire control mechanism 10 comprises a disconnector 40 arranged to rotate about the trigger axis 21. In some embodiments, the disconnector 40 is arranged to capture the hammer 30 while the trigger 20 remains depressed after firing a round.

In some embodiments, a fire control mechanism 10 comprises features as disclosed in U.S. Pat. Nos. 8,572,880, 9,696,103 and/or U.S. Ser. No. 10/222,161, the entire disclosures of which are hereby incorporated herein in their entireties.

Figure 2:
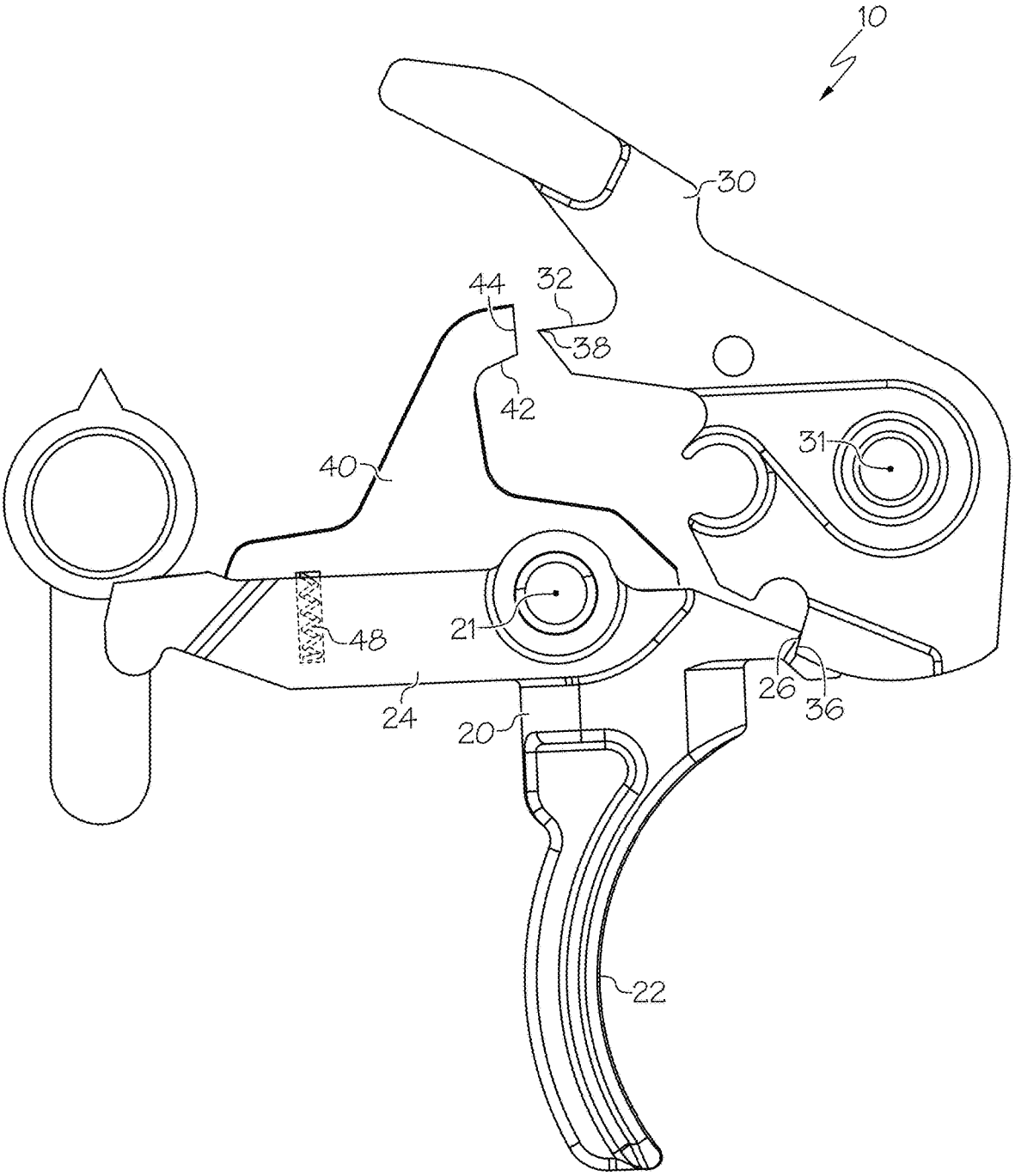
FIG. 2 shows an embodiment of a fire control mechanism in a first orientation.

FIG. 2 shows an embodiment of a fire control mechanism 10 in a first orientation. In some embodiments, a first orientation represents a cocked or ready-to-fire orientation.

In some embodiments, the trigger 20 comprises a finger portion 22 and an arm 24. In some embodiments, the finger portion 22 extends away from the trigger axis 21 in a first direction and the arm 24 extends away from the trigger axis 21 in a second direction. In some embodiments, a user can apply a force to the finger portion 22 to operate the fire control mechanism 10.

In some embodiments, the disconnector 40 is moveable with respect to the trigger 20. In some embodiments, the disconnector 40 is rotatable with respect to the trigger 20 about a disconnector axis 41. In some embodiments, the disconnector axis 41 is offset from the trigger axis 21 (not shown). In some embodiments, the disconnector 40 is supported by the trigger 20.

In some embodiments, the trigger 20 is supported by a trigger pin 27. In some embodiments, the disconnector 40 is supported by the trigger pin 27. In some embodiments, the disconnector axis 41 is collinear with the trigger axis 21, and both the trigger 20 and the disconnector 40 are arranged to rotate about the trigger axis 21. In some embodiments, the disconnector 40 is rotatable with respect to the trigger 20 about the trigger axis 21 between first and second positions. In some embodiments, a disconnector spring 48 is arranged to bias the disconnector 40 to the first position. In some embodiments, the disconnector spring 48 is arranged to bias the disconnector 40 in a first direction (e.g. clockwise) about the trigger axis 21. In some embodiments, the disconnector spring 48 biases the disconnector 40 away from the trigger 20. In some embodiments, the disconnector spring 48 comprises a compression spring positioned between the disconnector 40 and the trigger 20. In some embodiments, a first end of the disconnector spring 48 contacts the disconnector 40 and a second end of the disconnector spring 48 contacts the arm 24 of the trigger 20.

In some embodiments, the first and second positions of the disconnector 40 with respect to the trigger 20 represent end stop positions of travel of the disconnector 40. In some embodiments, the disconnector spring 48 is fully extended when the disconnector 40 is in the first position. In some embodiments, the disconnector spring 48 becomes loaded, or becomes subject to a greater amount of load, when the disconnector 40 moves from the first position. In some embodiments, the disconnector spring 48 is under the most load when the disconnector 40 is in the second position.

In some embodiments, the trigger 20 comprises a trigger sear 26 and the hammer 30 comprises a hammer sear 36. In some embodiments, the trigger sear 26 contacts the hammer sear 36 in the first orientation as shown in FIG. 2. In some embodiments, a force can be applied to the finger portion 22 of the trigger 20, causing the trigger 20 to rotate about the trigger axis 21, which causes the trigger sear 26 to slide along the hammer sear 36. When the trigger 20 has rotated enough for the trigger sear 26 to clear the hammer sear 36, the hammer 30 will fall (i.e. rotate, for example due to force provided by the hammer spring 33—see FIG. 1).

In some embodiments, the fire control mechanism 10 comprises a two-stage mechanism having two stages of operation or two stages of trigger 20 travel. In some embodiments, the pull weight required to rotate the trigger 20 about the trigger axis 21 in the second stage is different from the pull weight required to rotate the trigger 20 about the trigger axis 21 in the first stage. In some embodiments, the second stage requires a greater amount of force than the first stage.

In some embodiments, a full cycle of the fire control mechanism 10 comprises a first stage of trigger 20 travel, a second stage of trigger 20 travel, break/hammer 30 fall, catch and reset. The stages of trigger 20 travel are discussed with respect to FIGS. 2-4. In some embodiments, the break stage generally causes the hammer 30 to fall, which in turn fires a round and causes the associated firearm action to cycle, blowing back the hammer 30 and causing the hammer 30 to rotate in a second direction back toward the trigger 20 (e.g. counter-clockwise in FIG. 2). The hammer 30 contacts and displaces the disconnector 40, moving the disconnector 40 from its first position with respect to the trigger 20 as the hammer 30 moves past the disconnector 40 and reaches the end of its travel in the second direction. The hammer 30 then rotates in the first direction (e.g. clockwise), for example under the force of the hammer spring 33 (see FIG. 1), leading to the catch stage of operation. In some embodiments, the catch 42 of the disconnector 40 engages a hammer catch 32 portion of the hammer 30, allowing the disconnector 40 to stop movement of the hammer 30. In some embodiments, the disconnector 40 catch 42 will remain engaged with the hammer 30 until the user releases the finger portion 22 of the trigger, which allows the fire control mechanism 10 to reset. As force is lifted from the finger portion 22, the trigger 20 and disconnector 40 rotate about the trigger axis 21, allowing the hammer catch 32 to clear the disconnector 40 catch 42. In some embodiments, the fire control mechanism 10 is reset to the first orientation as shown in FIG. 2, with the trigger sear 26 contacting the hammer sear 36.

In some embodiments, the hammer sear 36 comprises a surface that is spaced apart from the hammer catch 32. In some embodiments, the hammer sear 36 comprises a surface that is oriented at an angle to the hammer catch 32 surface.

Figure 3:
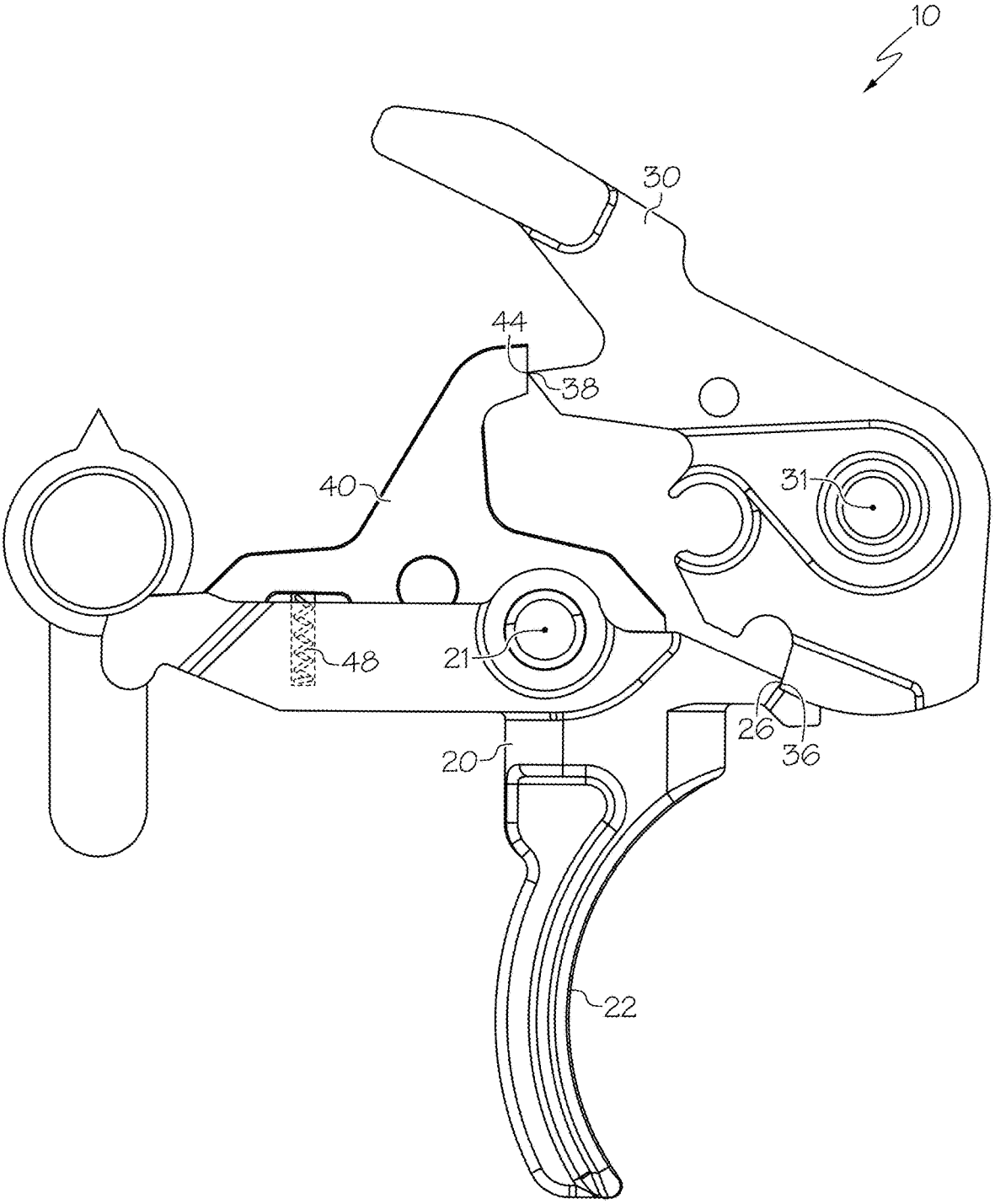
FIG. 3 shows an embodiment of a fire control mechanism in a second orientation.

FIG. 3 shows the fire control mechanism 10 of FIG. 2 in a second orientation. In some embodiments, the first stage of trigger 20 travel comprises the movement of components from the first orientation (FIG. 2) to the second orientation (FIG. 3). In the first and second orientations, the disconnector 40 is in its first position with respect to the trigger 20. In the second orientation, the trigger 20 and disconnector 40 have rotated about the trigger axis 21 in a first direction (e.g. clockwise) when compared to the first orientation.

In some embodiments, the hammer 30 comprises a secondary sear 38. In some embodiments, the disconnector 40 comprises a disconnector sear 44. In some embodiments, the secondary sear 38 contacts the disconnector sear 44. In some embodiments, in the second orientation (FIG. 3) the secondary sear 38 contacts the disconnector sear 44 and simultaneously the trigger sear 26 contacts the hammer sear 36.

In some embodiments, the second orientation as shown in FIG. 3 comprises a transition from the first stage to the second stage of operation. In some embodiments, movement of the trigger 20 beyond the second orientation (e.g. into the second stage) requires further rotation of the trigger 20 about the trigger axis 21; however, due to contact between the disconnector 40 and the hammer 30, the disconnector 40 must be displaced from its first position with respect to the trigger 20 to achieve further rotation of the trigger 20. Thus, in some embodiments, the disconnector spring 48 must be loaded or compressed during the second stage of operation.

Figure 4:
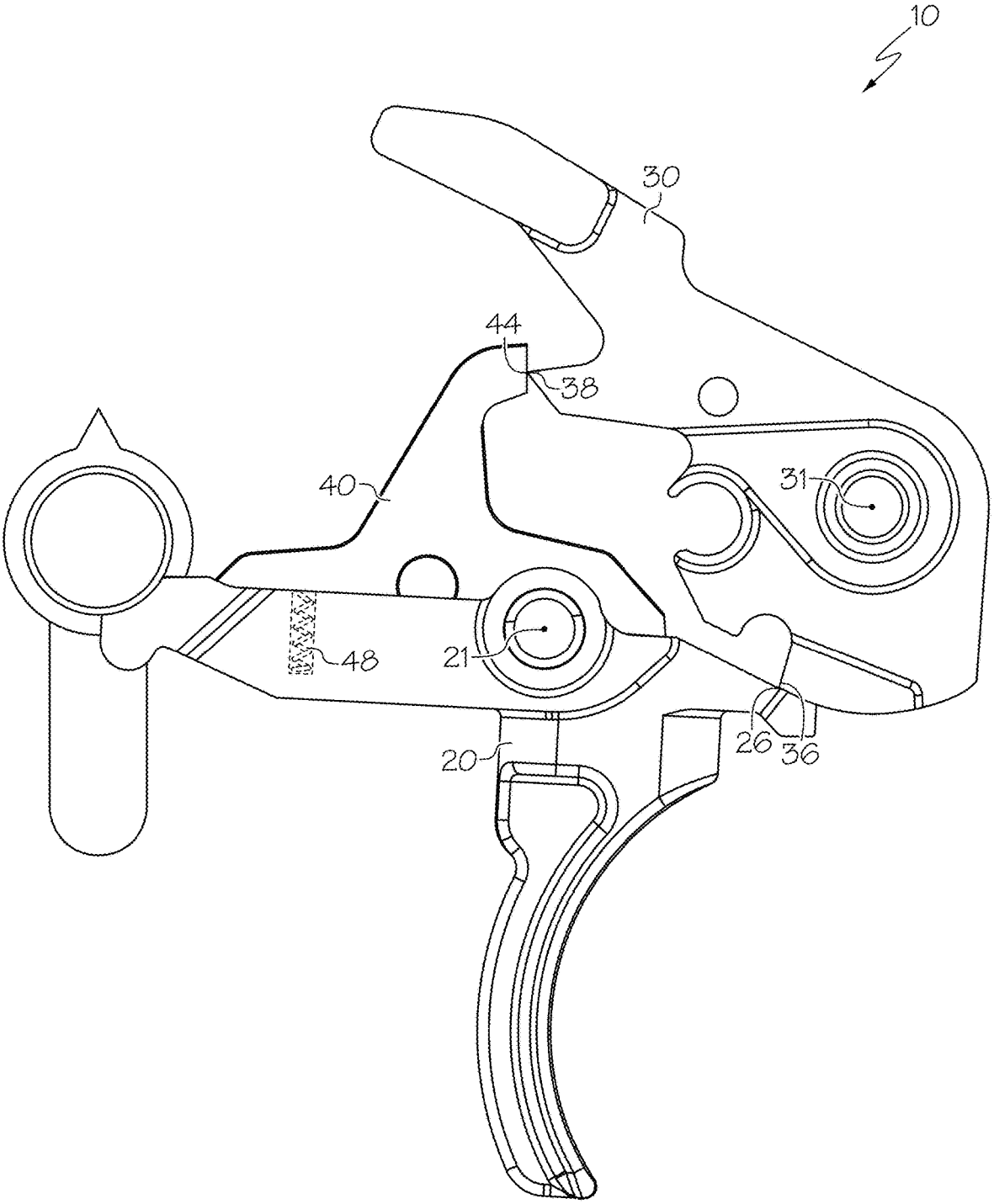
FIG. 4 shows an embodiment of a fire control mechanism in a third orientation.

FIG. 4 shows the fire control mechanism 10 of FIG. 2 in a third orientation. In some embodiments, the second stage of trigger 20 travel comprises the movement of components from the second orientation (FIG. 3) to the third orientation (FIG. 4). In some embodiments, in the third orientation, the disconnector 40 has been displaced from its first position with respect to the trigger 20. In some embodiments, in the third orientation, the disconnector spring 48 is compressed. In some embodiments, movement of the trigger 20 through the second stage of operation requires the pull force required to move the trigger 20 through the first stage of operation plus the pull force required to displace the disconnector 40.

FIG. 4 shows an orientation near the end of the second stage, with the trigger sear 26 close to clearing the hammer sear 36. Further rotation of the trigger 20 in the first direction (e.g. clockwise) will allow the hammer 30 to fall.

In some embodiments, a shape of the disconnector 40 can be adjusted to adjust the trigger pull forces required in the second stage. In some embodiments, a shape of the disconnector sear 44 can be adjusted to adjust the trigger pull forces required in the second stage. In some embodiments, a shape of the hammer 30 can be adjusted to adjust the trigger pull forces required in the second stage. In some embodiments, a shape of the secondary sear 38 can be adjusted to adjust the trigger pull forces required in the second stage. In some embodiments, the disconnector spring 48 can be adjusted, for example increasing or decreasing spring force, to adjust the trigger pull forces required in the second stage. Any suitable geometry can be used for these components to achieve any suitable trigger pull force and travel distance profile.

In some embodiments, the disconnector sear 44 comprises a bearing surface that bears against the secondary sear 38 of the hammer 30. In some embodiments, the secondary sear 38 comprises a bearing surface that bears against the disconnector sear 44. In some embodiments, the disconnector sear 44 comprises a surface that slides along the secondary sear 38. In some embodiments, the secondary sear 38 comprises a surface that slides along the disconnector sear 44.

Figure 5:
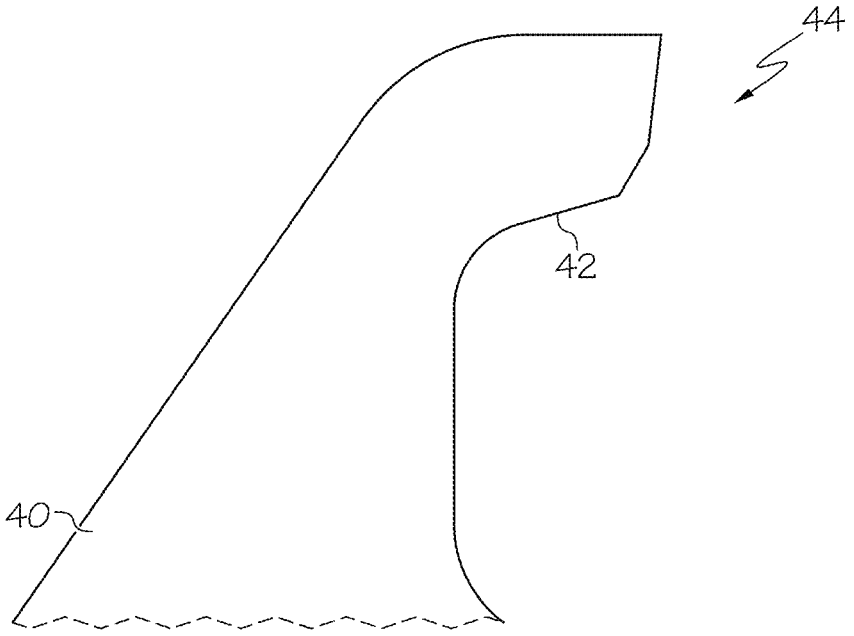
FIGS. 5 and 6 show embodiments of a disconnector.
Figure 6:
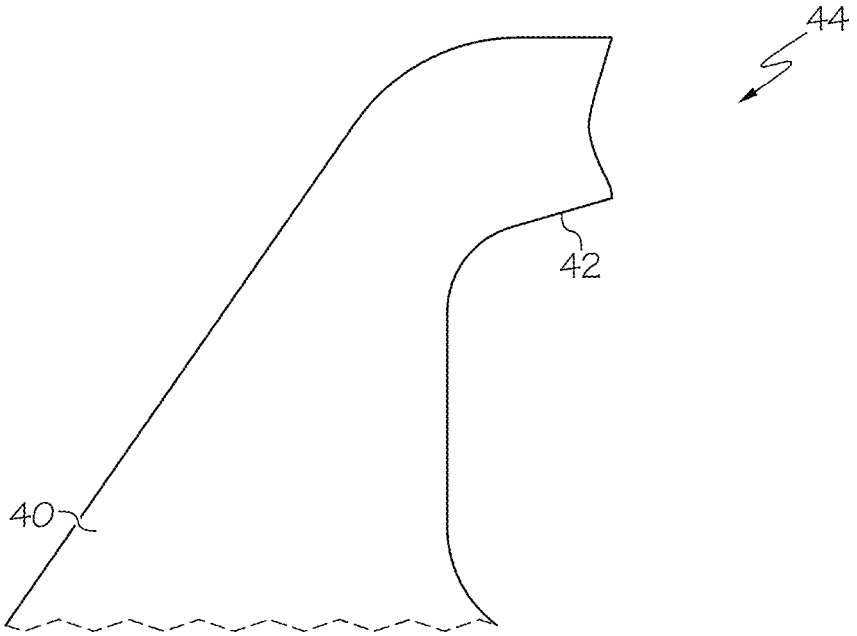

FIGS. 5 and 6 show additional embodiments of a disconnector 40. In some embodiments, a disconnector sear 44 comprises a flat surface. In some embodiments, a disconnector sear 44 comprises a planar surface. In some embodiments, a disconnector sear 44 comprises a curved surface. In some embodiments, a disconnector sear 44 comprises an angled surface. In some embodiments, the disconnector sear 44 is oriented at an angle to the disconnector catch 42.

Figure 7:
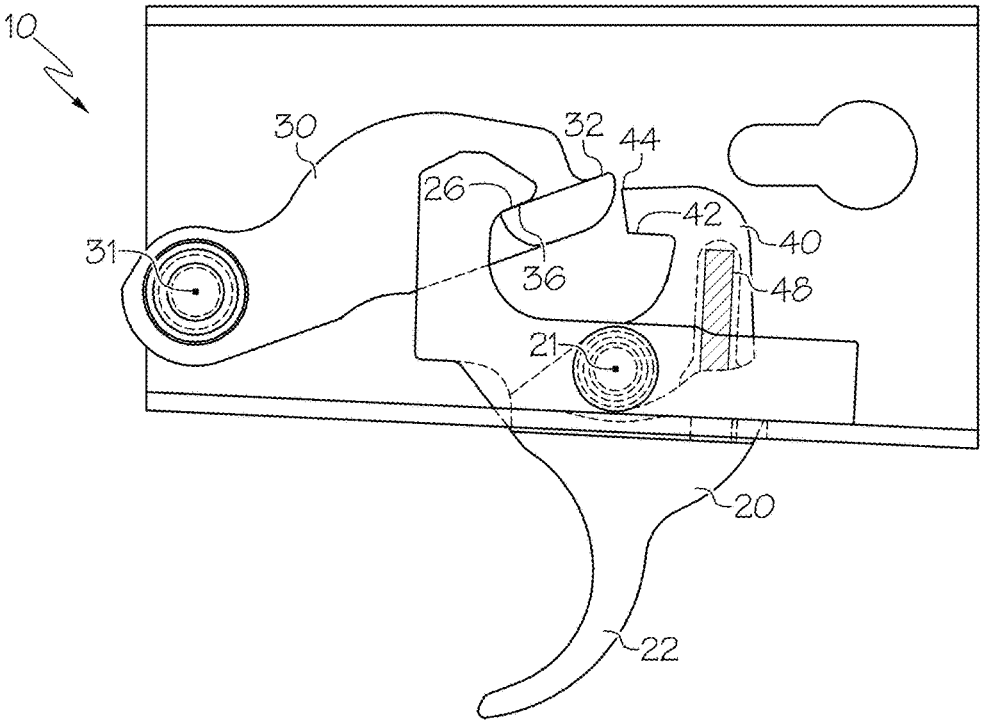
FIGS. 7-9 show another embodiment of the fire control mechanism.
Figure 7:
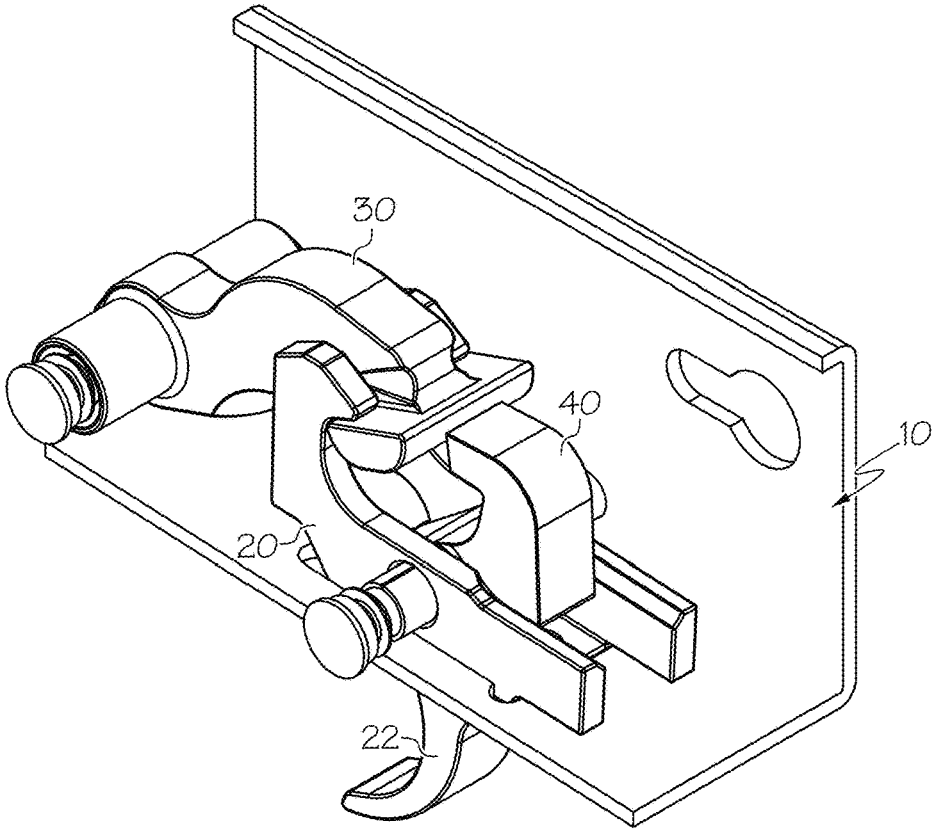
Figure 8:
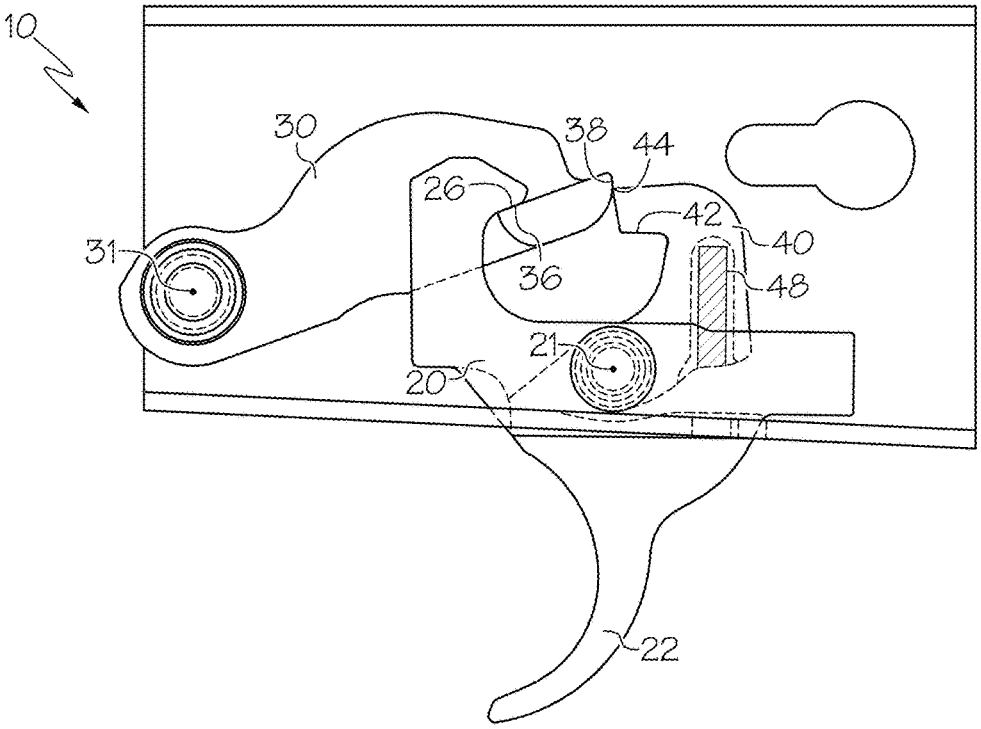
Figure 8:
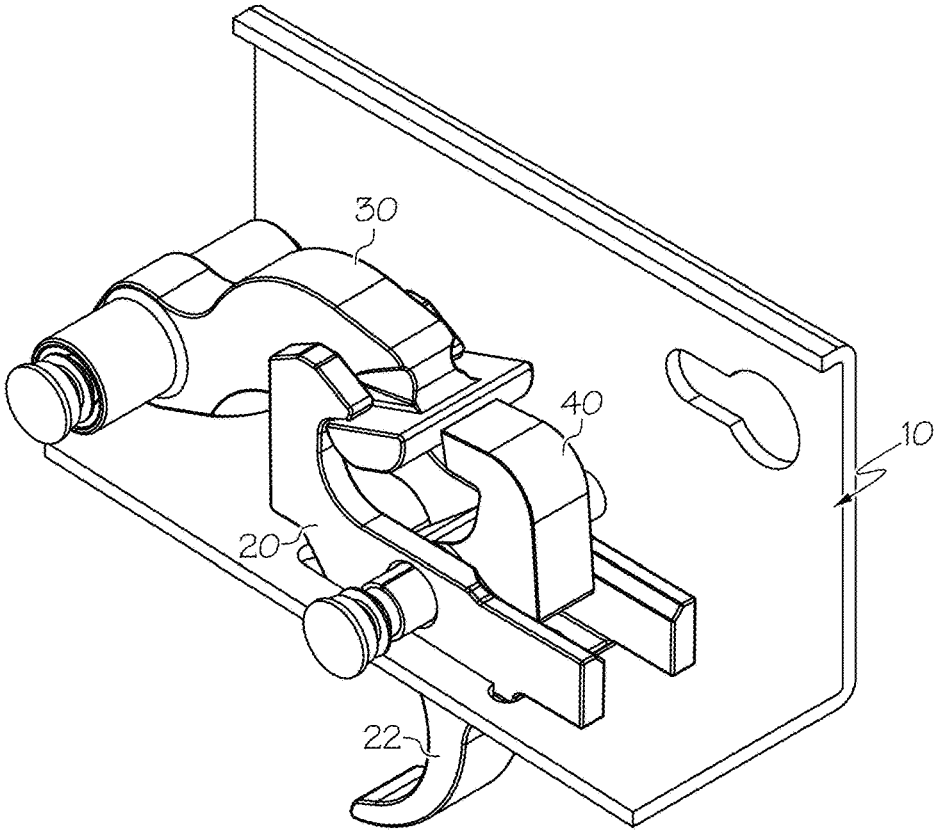
Figure 9:
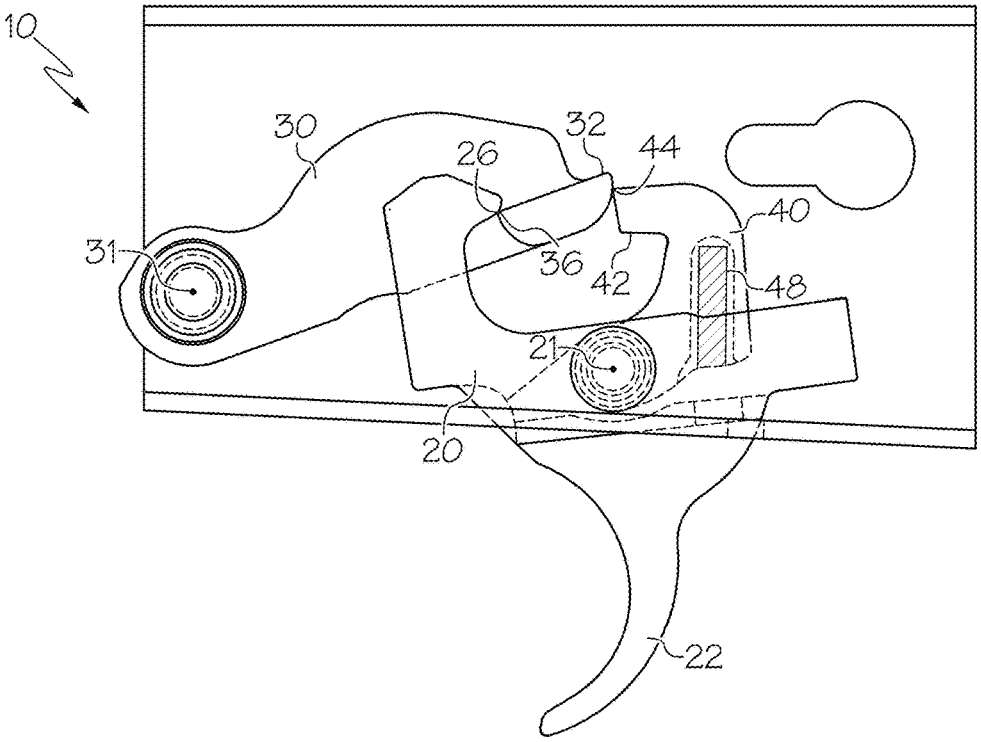
Figure 9:
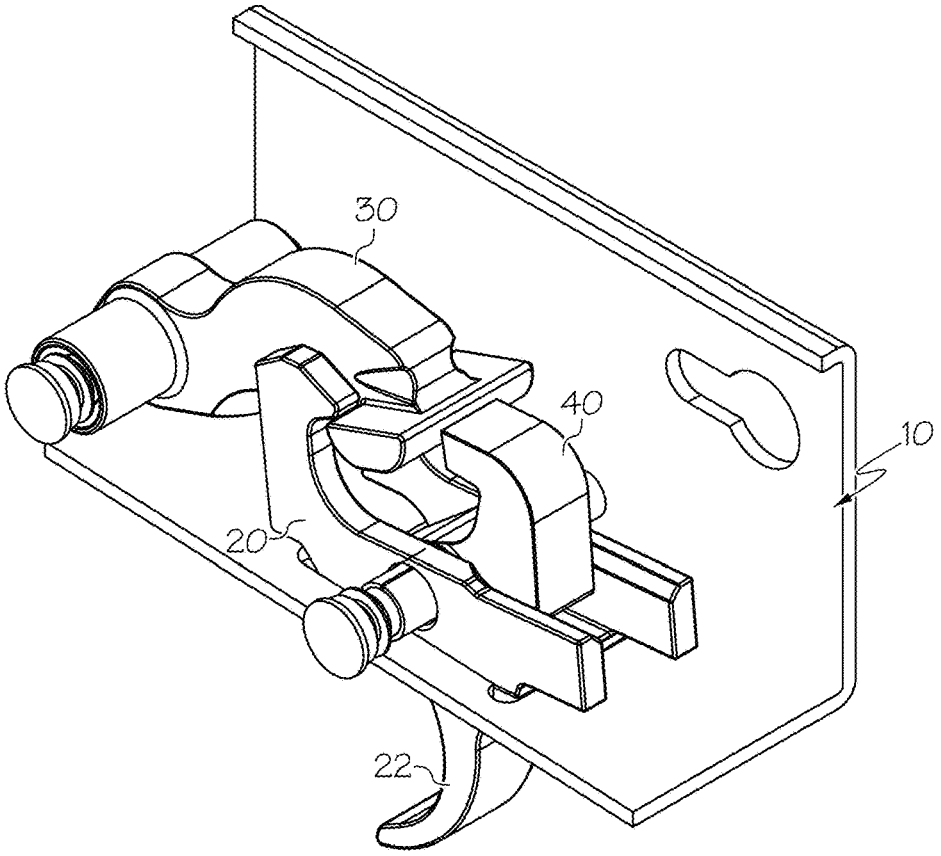

FIGS. 7-9 show another embodiment of a fire control mechanism 10.

In some embodiments, a fire control mechanism 10 is configured for use in an AK-style firearm.

In some embodiments, a hammer 30 comprises a surface comprising the hammer sear 36 and the hammer catch 32.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A fire control mechanism comprising:

a trigger arranged to rotate about a trigger axis, the trigger comprising a trigger sear;

a hammer arranged to rotate about a hammer axis, the hammer comprising a hammer sear and a secondary sear; and a disconnector arranged to move with respect to the trigger, the disconnector comprising a disconnector sear and a catch, the disconnector sear oriented at an angle to the catch;

a first reference plane extending through the trigger axis and the hammer axis;

the fire control mechanism comprising an orientation wherein the trigger sear contacts the hammer sear, and the secondary sear contacts the disconnector sear, the hammer sear is located to a first side of the first reference plane and the secondary sear is located to a second side of the first reference plane;

the disconnector sear comprising a planar surface defining a second reference plane, the second reference plane intersecting the first reference plane at an intersection, wherein the intersection and the hammer axis are located on opposite sides of the trigger axis.

2. The fire control mechanism of claim 1, the catch arranged to capture the hammer after a round is fired.

3. The fire control mechanism of claim 1, the orientation comprising a second orientation, the fire control mechanism comprising a first orientation wherein the trigger sear contacts the hammer sear and the secondary sear does not contact the disconnector sear.

4. The fire control mechanism of claim 3, the disconnector moveable with respect to the trigger between first and second positions, the disconnector in the first position in the second orientation.

5. The fire control mechanism of claim 4, the disconnector in the first position in the first orientation.

6. The fire control mechanism of claim 4, the fire control mechanism comprising a third orientation wherein the trigger sear contacts the hammer sear, the secondary sear contacts the disconnector sear and the disconnector is not in the first position.

7. The fire control mechanism of claim 6, comprising a disconnector spring, the disconnector spring fully extended in the first position.

8. The fire control mechanism of claim 7, the disconnector spring compressed in the second orientation.

9. The fire control mechanism of claim 1, the disconnector arranged to rotate about the trigger axis.

10. The fire control mechanism of claim 9, the trigger and disconnector supported by a trigger pin.

11. The fire control mechanism of claim 1, the disconnector arranged to rotate about a disconnector axis, the disconnector axis offset from the trigger axis.

12. The fire control mechanism of claim 1, the disconnector supported by the trigger.

13. A fire control mechanism comprising:

a trigger arranged to rotate about a trigger axis, the trigger comprising a trigger sear;

a hammer arranged to rotate about a hammer axis, the hammer comprising a hammer sear and a secondary sear; and a disconnector arranged to rotate about the trigger axis, the disconnector comprising a disconnector sear;

a first reference plane extending through the trigger axis and the hammer axis;

the fire control mechanism comprising a first stage and a second stage, in the first stage, the hammer sear contacts the trigger sear, in the second stage, the hammer sear contacts the trigger sear, and the secondary sear contacts the disconnector sear, the hammer sear is located to a first side of the first reference plane and the secondary sear is located to a second side of the first reference plane;

the disconnector sear comprising a planar surface defining a second reference plane, the second reference plane intersecting the first reference plane at an intersection, wherein the intersection and the hammer axis are located on opposite sides of the trigger axis.

14. The fire control mechanism of claim 13, comprising a disconnector spring, wherein the disconnector spring is compressed during the second stage.

15. The fire control mechanism of claim 13, the disconnector comprising a catch, the catch oriented at an angle to the disconnector sear.

* * * * *